United States Patent [19]

Rhoades et al.

[11] Patent Number: 4,989,507

[45] Date of Patent: Feb. 5, 1991

[54] COLLECTOR FOR EMPTY USED RECYCLABLE BEVERAGE CANS

[75] Inventors: William M. Rhoades; Lloyd D. Bailey, both of Forest Lake, Minn.

[73] Assignee: Gadar Industries, Inc., Forest Lake, Minn.

[21] Appl. No.: 377,068

[22] Filed: Jul. 10, 1989

[51] Int. Cl.[5] ..... B30B 9/00; B30B 9/32

[52] U.S. Cl. ..... 100/91; 100/99; 100/144; 100/173; 100/210; 100/902

[58] Field of Search ..... 100/902, 90, 91, 144, 100/151, 152, 155 R, 173, 210, 99

[56] References Cited

U.S. PATENT DOCUMENTS

| | | | |
|---|---|---|---|
| 4,059,050 | 11/1977 | Davis, Jr. | 100/902 X |
| 4,257,511 | 3/1981 | Miller | 100/902 X |
| 4,316,533 | 2/1982 | Hughes et al. | 100/902 X |
| 4,324,325 | 4/1982 | Dewoolfson | 100/902 X |
| 4,463,844 | 8/1984 | Huffman et al. | 100/902 X |
| 4,483,248 | 11/1984 | Ostreng | 100/902 X |
| 4,576,289 | 3/1986 | Jarrett et al. | 100/902 X |
| 4,653,627 | 3/1987 | Hampson et al. | 100/902 X |
| 4,667,832 | 5/1987 | Reinfeld | 100/902 X |

*Primary Examiner*—Philip R. Coe
*Assistant Examiner*—Stephen F. Gerrity
*Attorney, Agent, or Firm*—Jacobson and Johnson

[57] ABSTRACT

A large cylindrical enclosure shaped to look like a huge beverage can has a recessed area in its outer wall containing an operator's panel and an opening into the interior for inserting empty recyclable beverage cans. Inside the enclosure is a conveyor for receiving the inserted cans, means for distinguishing between ferrous and non-ferrous recyclable cans, means for counting the number of ferrous and non-ferrous cans and pneumatic transporting means for carrying the cans to a mechanical crusher which compacts the cans individually and discharges them into a temporary storage area from which they are removed from time to time for recycling. The operator's panel includes manually operable buttons for initiating operation of the mechanisms in the interior of the strucutres and may also include various visual readouts as well as a dispenser for feeding out coins, printed credit slips and receipts. The machine also contains programmable electronic circuitry for providing information and controls necessary for operation of the equipment and for determining the amount of payout and other useful data and information.

5 Claims, 5 Drawing Sheets

COLLECTOR FOR EMPTY USED RECYCLABLE BEVERAGE CANS

FIELD OF THE INVENTION

This invention is a convenience for gathering and temporarily storing empty recyclable beverage cans that an average consumer or householder may accumulate in relatively small numbers. The can collector can be conveniently located and the cans can be conveniently and easily deposited into the machine which compacts or crushes the cans and temporarily stores them within the enclosure from which they are eventually transported to a recycling station. The invention provides means for counting the deposited cans, means for determining if they are aluminum or non-aluminum, and may have means to compensate the depositor with cash or credit slips in payment for the deposited cans. In the latter case, the can collector becomes a reverse vending machine.

SUMMARY OF THE INVENTION

A large vertically extending cylindrical enclosure, shaped to look like a huge beverage can has an intermediate floor dividing the interior into lower and upper compartments or chambers. An opening into the lower compartment permits cans to be deposited, preferably one at a time, and means are provided in the lower compartment to receive, count and transport the cans to the upper compartment which contains a machine for crushing each of the cans and a storage area where the crushed cans are accumulated. Outside access doors are provided to the upper compartment for removal of the crushed cans from time to time for transportation to a recycling station. The outside of the structure has a panel area with operating instructions, manually operable pushbuttons for starting and stopping operation of the machine, visual indicators and a chute for dispensing coins and/or a printed credit slip for payment for the deposited cans and a printed receipt. In the lower chamber there is a conveyor for receiving the deposited cans which has a magnetized section for magnetically grasping magnetically permeable or ferrous cans and for carrying all of the deposited cans to a pair of vacuum conduits. One of the conduits sucks up the aluminum or other non-ferrous cans from the magnetized section of the conveyor and the other conduit sucks up the non-aluminum or ferrous cans from the non-magnetized section of the conveyor. A coil wrapped around each of the vacuum conduits provides an electrical signal for use in counting the number of cans passing through the respective conduits so that the ferrous and non-ferrous cans are counted separately. The individual vacuum conduits join together and carry the cans to a high velocity air conduit, which transports the cans to a crushing machine in the upper chamber. By using vacuum and high velocity air for transporting the cans, light trash such as paper, leaves, etc., can be separated and dropped into a trash container. Inside the structure is a micro-processor which can be programmed to keep a record of the number and types of cans that are deposited and to trigger the payout mechanism which dispenses coins and a printer for printing out a credit slip in payment for the deposited cans and a receipt. When used in this fashion, the machine can be considered to be, and is sometimes referred to as, a reverse vending machine, i.e., making payment for cans deposited as distinguished from the normal vending machine which dispenses canned beverage upon the receipt of deposited coins. The micro-processor can also be programmed to perform other record-keeping tasks and for energizing a printer to print out data as desired.

DESCRIPTION OF THE PREFERRED EMBODIMENT

Figure 1:
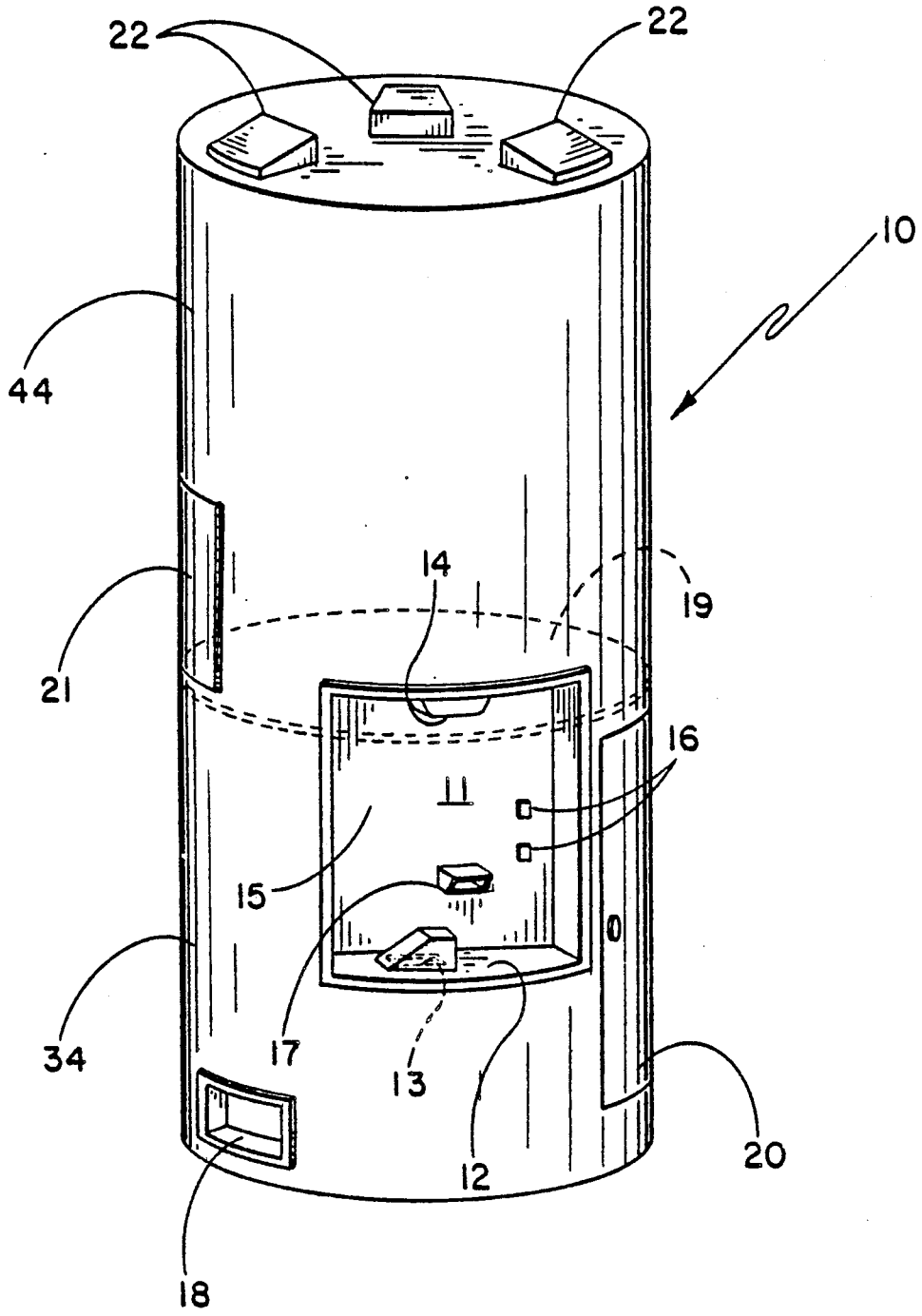
FIG. 1 is an elevational view of the exterior of a can collector constructed according to the teachings of this invention.

A vertically disposed cylindrical enclosure 10 which is shaped to have the appearance of a huge beverage can has a recessed area 11 in the outer wall with a horizontal platform 12 containing a hooded opening 13 into the interior of the enclosure through which beverage cans can be deposited. Preferably the opening is just large enough to receive the cans only one at a time. The recessed area 11 may be provided with an overhead light 14 and a vertical panel 15 containing printed instructions and information as well as visual indicators if desired, not shown. Also, mounted on panel 15 are a pair of manually operable push buttons 16 which are used to manually start and stop the mechanisms within the enclosure. Ordinarily only the start button has to be pushed and once the mechanisms have been started they will continue through their cycle of operation and will automatically stop when completed. The stop button can be used in case of a malfunction or to stop the mechanism at any time. A chute 17 may also be provided for dispensing coins or a credit slip in payment for the deposited cans and a receipt containing a printout of the transaction. Near the bottom of enclosure 10 is a discharge chute 18 for refuse or rejected cans.

The interior of enclosure 10 is separated into lower and upper compartments or chambers designated by reference numerals 34 and 44 respectively, by an intermediate raised floor 19. An access door 20 allows entry into the interior of the lower chamber 34 of enclosure 10 for maintenance and repair of the mechanisms located inside and access door 21 to the interior of upper chamber 44 is provided for removal of crushed cans that are temporarily stored in the collector. The top of the enclosure is generally provided with suitable conventional air vents 22.

Figure 2:
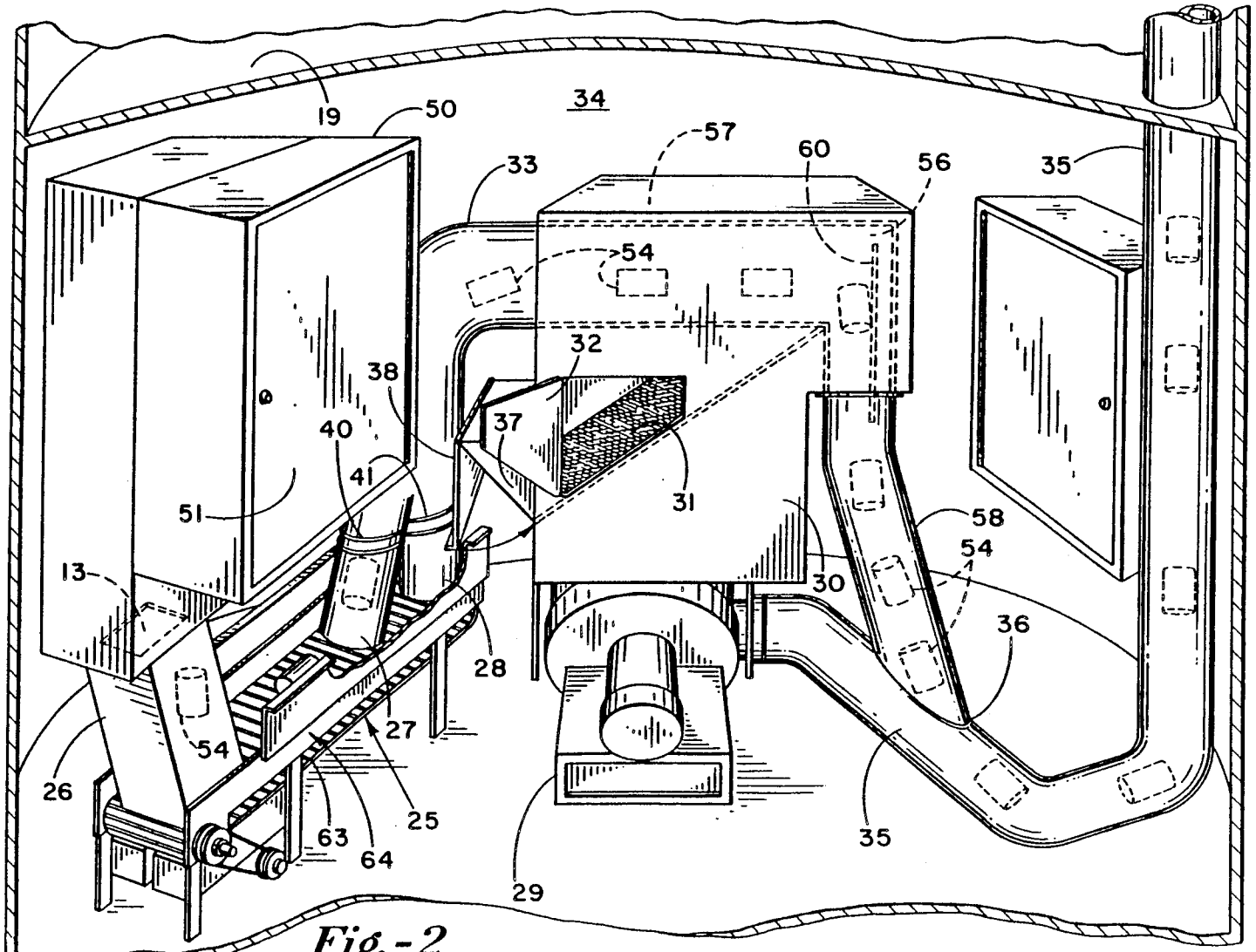
FIG. 2 is a view of the interior of the lower compartment of the collector.
Figure 4:
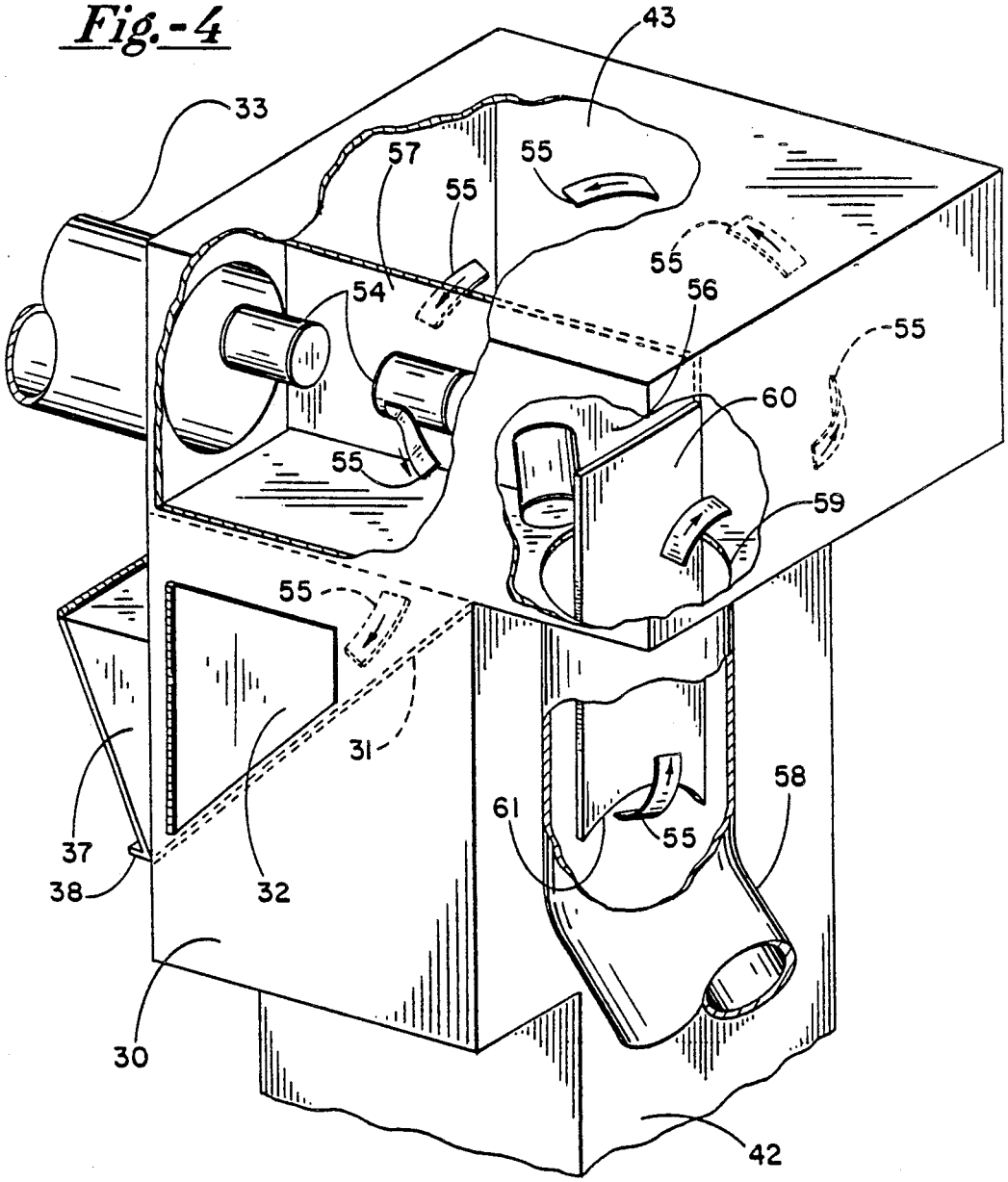
FIG. 4 is a partial breakaway perspective view illustrating how cans and trash are separated.

Within lower chamber 34 of enclosure 10 located just below the recessed area 11 is a motor driven endless belt conveyor 25 and a chute 26 directs the cans 54 that are inserted through opening 13 onto one end of conveyor 25. Conveyor 25 carries the deposited cans toward vacuum or suction conduits 27 and 28. A motor driven air blower, generally designated by reference numeral 29, produces a vacuum or a suction at its input side which is coupled by duct 42 (FIG. 4) to the bottom of the interior chamber of a sheet metal housing 30. The interior chamber of housing 30 contains a perforated downwardly sloped screen 31. A front door 32 hinged to housing 30 is normally locked closed, but is shown in the open position for the convenience of showing perforated screen 31 in the interior of housing 30. Housing 30 has hooded opening 37 with a hinged free swinging door 38 at one side. When vacuum is applied into the interior of housing 30 through duct 42 by blower 29 the suction is such that it pulls door 38 to close the hooded opening 37. When the suction is removed, door 38 swings open permitting removal of trash from screen 31. At its top back side, as viewed in FIG. 2, housing 30 is open to duct 43 (FIG. 4) which is in air communication through opening 56 with can transporting chamber 57. At its other end chamber 57 is coupled to can transporting pipe or conduit 33 which separates into conduits 27 and 28, FIG. 2. In this manner conduits 27 and 28 receive the suction to pick up cans from conveyor 25 so they can be transported for processing.

Figure 3:
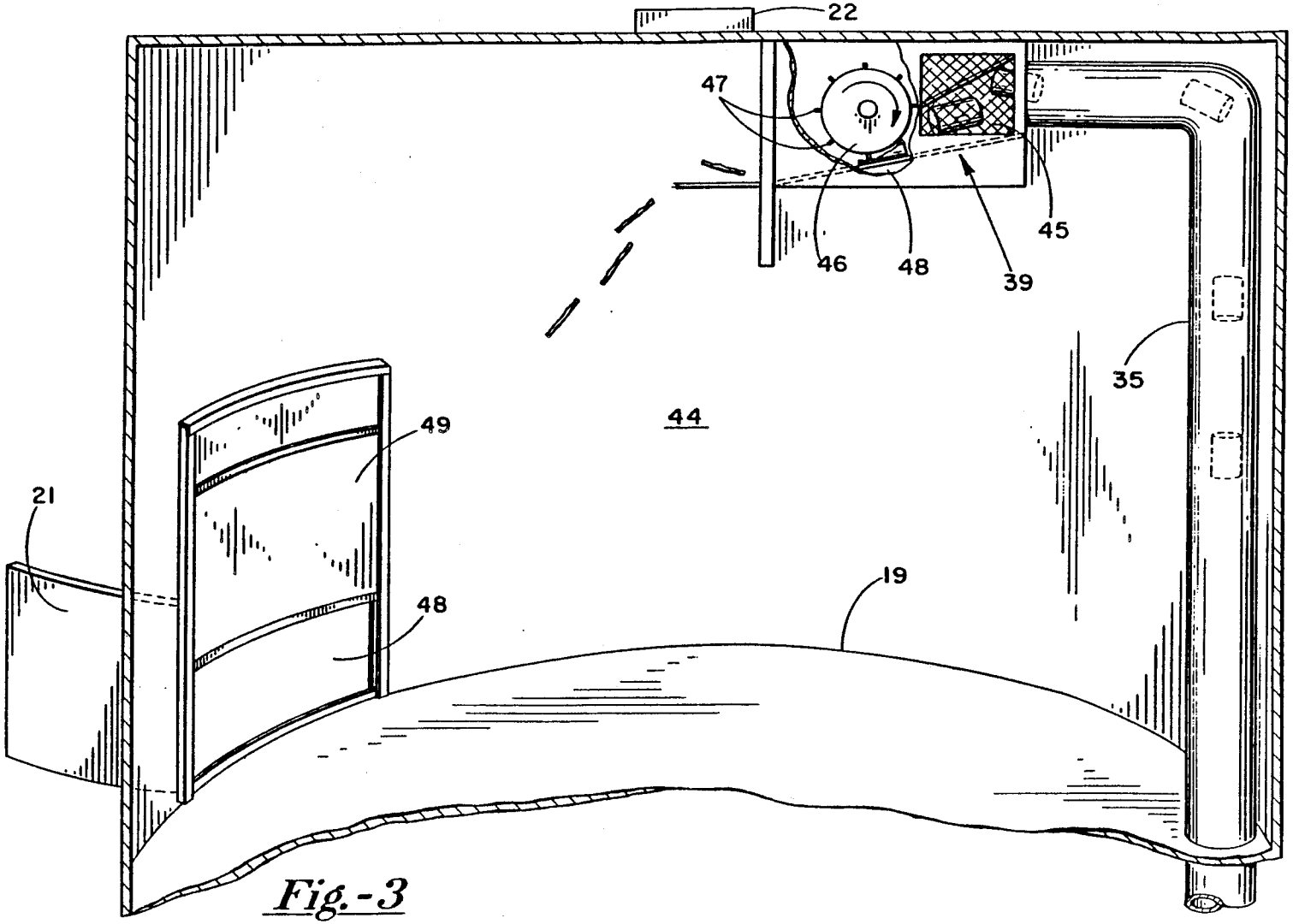
FIG. 3 is a view of the interior of the upper compartment.

At its output side, blower 29 produces high velocity air flow which is fed into pipe or conduit 35 to carry cans 54 to the can crusher 39 in the upper compartment 44, FIG. 3. Cans 54 are brought to pipe 35 by pipe or conduit 58 which is joined or coupled at one end to pipe 35 at 36 and at its other end to opening 56 of can-carrying chamber 57 via an opening 59 in the bottom of duct 43, FIG. 4. Extending about diametrically across circular opening 59 at one end of pipe 58 is a vertically extending baffle 60 which can be adjustably raised and lowered to partially close off or further open suction communication through opening 56 into chamber 57 from duct 43. The lower edge 61 of baffle 60 is arced to minimize the chance of light trash 55 catching on the edge of baffle 60.

As will be described later in greater detail, the first section of conveyor belt 63, from its can-receiving end, is magnetized to magnetically grasp deposited steel or other ferrous or magnetically permeable cans strongly enough so that as they pass the opening of suction conduit 27 they are not sucked up and only the aluminum or non-magnetic or non-ferrous metal cans are sucked up into conduit 27. Toward its far end conveyor belt 63 is not magnetized so that any cans remaining on the conveyor, which should be ferrous cans, which arrive at the opening of conduit 28 are sucked up. Electrical coils 40 and 41 respectively wrapped around conduits 27 and 28 produce an electrical signal for each can that passes through the conduit. These electrical signals are fed to suitable electronic circuitry for counting individually the number of aluminum and non-aluminum cans which are deposited into the machine.

With suction applied by blower 29 cans 23 are sucked up by conduit 27 and/or conduit 28 and transported through conduit 33 and chamber 57. The velocity of the transported cans causes them to strike baffle 60 after they pass through opening 56 of chamber 57 and by gravity they fall downward through the inboard side of opening 59 into conduit section 58 which carries them into high-velocity air conduit 35. Light trash 55, such as leaves or paper or the like, which might be sucked up by conduits 27 and 28 and carried along with the cans into chamber 57 are generally drawn by the suction in duct 43 as they leave opening 56 upward around the bottom edge 61 of baffle 60 and are carried to the interior of housing 30 where they are deposited on screen 31.

The cans 23 are transported by the high velocity air in conduit 35 upward through intermediate floor 19 to a can crusher 39 in the upper chamber 34 of enclosure 10 Crusher 39 has an inlet chute 45 which directs the cans toward the lower portion of a rotating metal cylinder 46 which has circumferentially spaced outer elongated teeth 47 which help to grasp the cans indvidually as they arrive from chute 45 so they are crushed between the rotor 46 and a bottom compacting plate 48. The crushed cans are discharged from the crusher onto floor 19. As illustrated in FIG. 3 preferably crusher 39 is mounted at the interior top of upper chamber 34 so that the crushed cans fall from crusher 39 to floor 19 and the crusher is out of the way of the accumulating crushed cans to remove the stored cans from the storage area, access door 21 is opened and the cans are removed through opening 48. A sliding panel 49 may also be provided to control the rate at which the cans exit from the storage area and also to stop the flow of crushed cans if the load is too great.

Any cans or other materials which are not sucked up by vacuum conduits 27 or 28 will fall off the far end of conveyor 25 into a chute, not shown, which carries them to discharge outlet 18. Also, after air compressor 29 turns off door 38 will swing open allowing any trash gathered on screen 31 to fall out of the chamber 30 into a waste receptacle, not shown. Some of the trash may stick to screen 31 so from time to time screen 31 may have to be manually cleaned.

Box 50 attached to the interior of the lower chamber of the enclosure 10 opposite the recess 11, has a hinged access door 51 and contains electronic circuitry in the form of a micro-processor programmed to use the counting signals generated by coils 40 and 41 to determine the amount of payment for the deposited cans and to activate a coin dispenser and/or print out a receipt or credit slip along with a summary of the transaction showing the number and types of cans deposited, etc. Box 50 also contains wiring to push buttons 16 as well as to any visual indicators on panel 15 and may also include electrical circuits and components for checking the operation of the mechanisms and for automatically shutting off the mechanisms if a malfunction occurs or after all the deposited cans have been processed.

Figure 5:
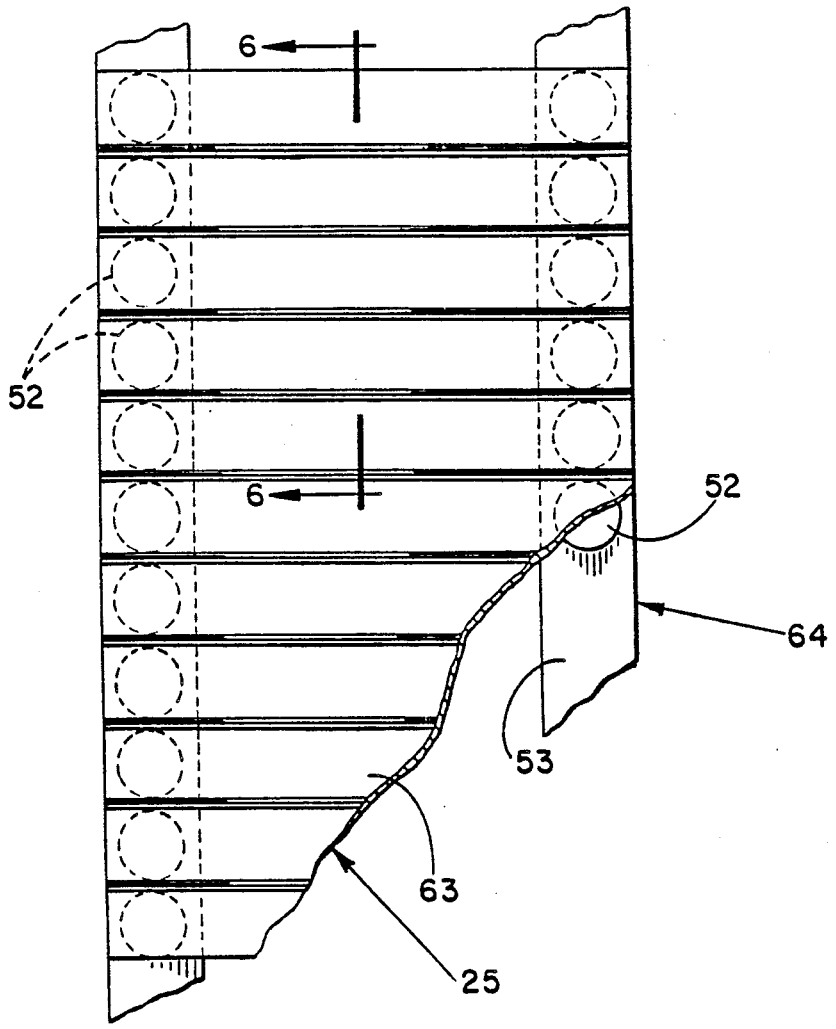
FIGS. 5 and 6 are more detailed views of an embodiment of a conveyor used in the invention for distinguishing between ferrous and non-ferrous cans.
Figure 6:
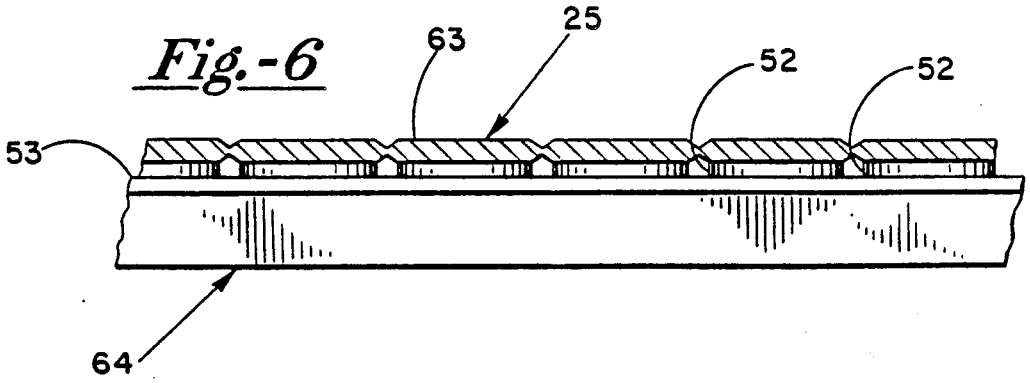

FIGS. 5 and 6 illustrate one manner of magnetizing endless belt conveyor 25 for holding the magnetically permeable cans on the conveyor as they pass the first suction conduit 27 and then release them as they near the second suction conduit 28. Endless belt 63 is conventionally made from a series of joined slats of some suitable nonmagnetic material and the upper reach of the belt is slideably supported in conventional fashion along its outer edges by inward flanges, not shown, on conveyor frame 64. A series of closely spaced ceramic disk magnets 52 rest on and are attached to a ledge 53 extending inward from frame 64 along an edge of and just below the upper reach of belt 63. The magnets 52 are located over a section of conveyor 25 extending generally from near the input end to just beyond the first suction or vacuum conduit 27 so that the ferrous or magnetically permeable cans are attracted or grasped by the magnetic field of magnets 52 and are not sucked up by the vacuum in conduit 27. The cans which are not sucked up by vacuum conduit 27 are carried by conveyor belt 63 past vacuum conduit 27 and when they are close enough to vacuum conduit 28 the absence of the magnetic field permits the cans to be sucked up into vacuum conduit 28. As illustrated in FIG. 5, a set of ceramic disk magnets 52 may be placed along each edge of conveyor belt 63 to insure the magnetic grasping of the magnetically permeable cans up to and at least part way beyond vacuum conduit 27.

I claim:

1. A collector for empty used recyclable metal beverage cans, comprising:

a large cylindrical enclosure having an interior area;

an opening into the interior area of said enclosure for inserting empty used beverage cans;

conveying means in the interior area of said enclosure for receiving cans inserted through said opening, said conveying means comprising an endless belt with one end of the conveying means located to receive the inserted cans, a part of said conveying means being magnetized for magnetically holding only magnetically permeable cans firmly onto said belt;

can crushing means in the interior area of said enclosure;

means in the interior area of said enclosure for pneumatically transporting each of the cans from said conveying means to said can crushing means, said pneumatic transporting means including a pair of vacuum suction conduits suitably sized to carry beverage cans, one of said conduits having an open end facing and in close proximity to the magnetized part of said conveying means and the other of said conduits having an opening facing and in close proximity to a non-magnetized part of said conveying means;

means for applying a vacuum to said conduits for respectively sucking up into said conduits cans which are not magnetically held onto said belt on the respective parts of said belt; and means in the interior area of said enclosure for receiving and storing crushed cans from said crushing means.

2. The beverage can collector as described in claim 1 further including can counting means comprising wire-wound coil means wrapped around each of said vacuum conduits for producing an electrical signal each time a can enters one of said vacuum conduits.

3. The beverage can collector as described in claim 1 wherein said pneumatic transporting means further includes:

second conduit means coupled to said pair of vacuum conduits for receiving cans from said pair of vacuum conduits;

third conduit means coupled between said second conduit means and said can crushing means; and means for applying pressurized air to said third conduit means for transporting the cans received from said second conduit means to said can crushing means.

4. A collector for use in recycling used empty metal beverage cans, comprising:

a large vertically oriented cylindrical enclosure closed at its top and having an interior area;

an elevated floor within the interior area of said enclosure separating the interior area of said enclosure into a lower and an upper chamber;

an opening into the lower chamber of said enclosure for inserting empty metal beverage cans one at a time;

conveying means in the lower chamber of said enclosure for receiving cans inserted through said opening;

vacuum conduit means in the lower chamber of said enclosure for sucking up cans from said conveying means;

can crushing means located at the top of the upper chamber of said enclosure;

can counting means including a wire wound coil means wrapped around said vacuum conduit means for producing an electrical signal for each can which passes through said coil means; and pressurized air conduit means coupled to said vacuum conduit means for pneumatically transporting cans received from said vacuum conduit means through said elevated floor to said can crushing means.

5. The can collector as described in claim 4 wherein said crushing means discharges crushed cans onto said elevated floor.

* * * * *